United States Patent [19]

Griffin

[11] Patent Number: 4,662,520

[45] Date of Patent: May 5, 1987

[54] LID CONSTRUCTION FOR BOWLS AND THE LIKE

[76] Inventor: Leonard R. Griffin, 351 N. Church St., St. Peters, Mo. 63376

[21] Appl. No.: 832,257

[22] Filed: Feb. 20, 1986

[51] Int. Cl.[4] ..... G09F 11/04; G09F 9/37

[52] U.S. Cl. ..... 206/459; 215/230; 206/493; 40/495; 40/307

[58] Field of Search ..... 206/459, 534; 116/309, 116/316; 215/230; 40/306, 307, 495

[56] References Cited

U.S. PATENT DOCUMENTS

| | | | |
|---|---|---|---|
| 83,367 | 10/1868 | Davis | 40/307 |
| 261,131 | 7/1882 | Bonshire | 116/309 |
| 602,053 | 4/1898 | Brodif | 40/495 |
| 828,353 | 8/1906 | Walsh | 116/309 |
| 1,349,321 | 8/1920 | Carter, Jr. | 40/495 |
| 1,621,902 | 3/1927 | Raschick | 215/230 |
| 3,151,599 | 10/1964 | Livingston | 215/230 |
| 3,424,336 | 1/1969 | Perez et al. | 206/459 |
| 3,739,740 | 6/1973 | Fromer | 206/459 |
| 3,818,858 | 6/1974 | Kramer et al. | 215/230 |
| 4,347,804 | 9/1982 | Villa-Real | 206/459 |
| 4,421,230 | 12/1983 | Stanton | 206/493 |

FOREIGN PATENT DOCUMENTS

| | | | |
|---|---|---|---|
| 165470 | 2/1934 | Switzerland | 40/495 |
| 224090 | 1/1943 | Switzerland | 206/459 |
| 2076458 | 12/1981 | United Kingdom | 206/493 |

*Primary Examiner*—William Price
*Assistant Examiner*—Brenda J. Ehrhardt
*Attorney, Agent, or Firm*—Haverstock, Garrett and Roberts

[57] ABSTRACT

A lid construction adapted to be utilized on bowls and the like includes a lid member having top and bottom surfaces, a first set of indicia disposed upon the top surface of the lid member, a rod member extending through and upwardly from a center portion of the lid member, and at least two rotatable discs including a first rotatable disc mounted on the lid member and rotatable relative thereto about the rod member, the first rotatable disc including a cut-out portion extending therethrough defining a window and a second set of indicia disposed thereupon, and a second rotatable disc mounted on top of the first rotatable disc and rotatable relative thereto about the rod member, the second rotatable disc including a cut-out portion extending therethrough defining a window. The first rotatable disc is adapted to be rotated to align the window therethrough with selected indicium of the first set of indicia and the second rotatable disc is adapted to be rotated to align the window therethrough with selected indicium of the second set of indica.

9 Claims, 5 Drawing Figures

LID CONSTRUCTION FOR BOWLS AND THE LIKE

BACKGROUND OF THE INVENTION

1. Field of the Invention

The present invention relates to a lid construction for visually displaying indicia disposed thereon, and, more particularly, to an adapted lid construction having indicia disposed thereon and means for displaying such indicia whereby a person can visually identify the type of left-over food placed in the bowl and can identify the date on which such food was placed therein and can identify such further information as is desired.

2. Prior Art

Prior art lid constructions for visually registering indicia include Kramer et al U.S. Pat. No. 3,818,858; Sasson U.S. Pat. No. 4,041,628; Wawracz U.S. Pat. No. 3,921,806; and, Simeone U.S. Pat. No. 2,024,889. These prior art constructions have the indicia and the means by which the indicia is displayed incorporated directly into the lid thereby rendering them relatively expensive to manufacture. Furthermore, these prior art constructions, while indicating a particular day or date on which a food substance was placed in a bowl, are not adapted to identify the particular type of food stored in such bowl. Therefore, when several of the prior art constructions are utilized together, the user is required to open each bowl until the desired food is uncovered.

SUMMARY OF THE INVENTION

The present invention provides a lid construction whereby the indicia as well as the means for displaying such indicia are removable and are adapted to be utilized in conjunction with a premanufactured lid. The present invention further provides a lid construction adapted to be utilized on bowls and the like whereby a person can visually identify at least the type of left-over food placed in the bowl and can identify the date on which such food was placed therein. The lid construction of the present invention includes a lid member having a first set of indicia disposed upon the top surface around the center thereof, each indicium being adapted to identify a type of food and at least two rotatable discs mounted thereon. A first rotatable disc is mounted on the lid member and is rotatable relative thereto about a rod member which extends through and upwardly from the center of the lid member. A second rotatable disc, smaller in diameter than the first rotatable disc, is mounted on the first rotatable disc and is rotatable relative thereto about the same rod member. The first rotatable disc includes a cut-out portion extending therethrough defining a window along the circumference thereof and a second set of indicia disposed on the top surface thereof around the center, each indicium being adapted to identify a day or date. The second rotatable disc also includes a cut-out portion extending therethrough defining a window along the circumference thereof. The first rotatable disc is adapted to be rotated to align the window therethrough with the first set of indicia disposed upon the lid member to thereby identify the particular type of food stored in the bowl. The second rotatable disc is adapted to be rotated to align the window therethrough with the second set of indicia disposed upon the first rotatable disc to thereby identify the particular date on which the food was stored in the bowl. Additional rotatable discs may also be utilized to display still other sets of indicia by mounting such discs on the lid member and providing them with a window.

An alternate embodiment includes first and second rotatable members which are removable from the lid member so that each individual member can be cleaned independently, and first and second sets of indicia which are removable so that such indicia can be changed to identify other types of food, can be removed so that the disc members can be cleaned, or can be replaced when the original indicia becomes illegible.

Furthermore, premanufactured lid members can be adapted to receive the first and second rotatable discs and the first and second sets of indicia by providing the lid with a rod member and mounting the rotatable disc thereon and further by disposing the indicia upon the surfaces in a preferred arrangement.

Accordingly, a principal object of the present invention is to provide a lid construction for bowls and the like having means thereon for visually displaying sets of indicia.

Another object is to provide a lid construction adapted to permit a person to visually identify the type of food stored in a container and the date or day on which such food was placed in the container.

Another object is to provide a lid construction having sets of indicia and means for visually displaying such sets of indicia, all of which are removable from a lid member.

Still another object is to provide sets of indicia and means for visually displaying such sets of indicia, all of which are adaptable to be utilized in conjunction with a premanufactured lid member.

These and other objects and advantages of the present invention will become apparent after considering the following detailed specification in conjunction with the accompanying drawings.

DETAILED DESCRIPTION OF THE PREFERRED EMBODIMENT

Figure 3:
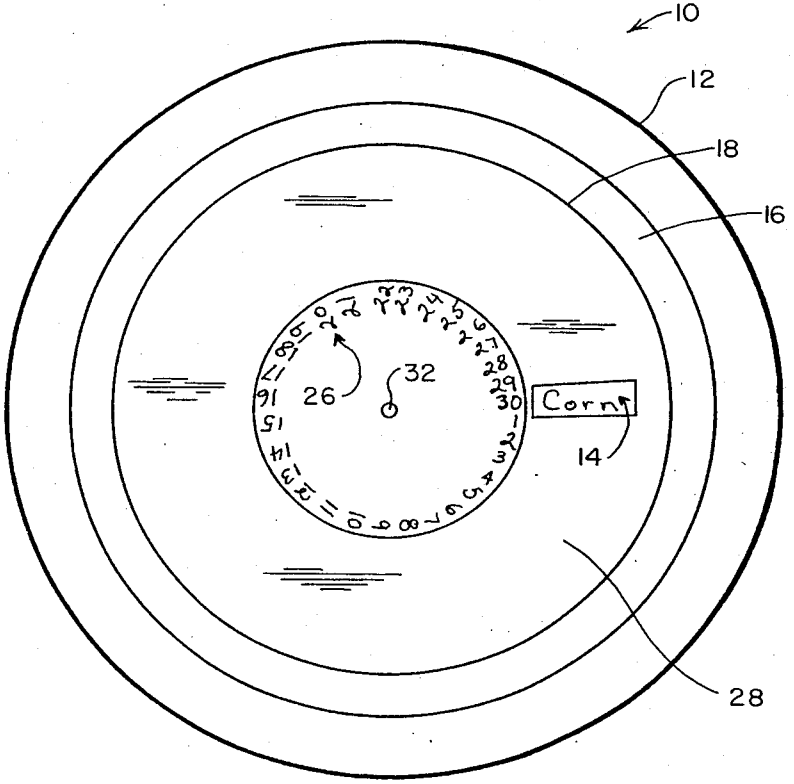
FIG. 3 is a second plan view of the lid construction of FIG. 1 showing the second rotatable disc removed.
Figure 1:
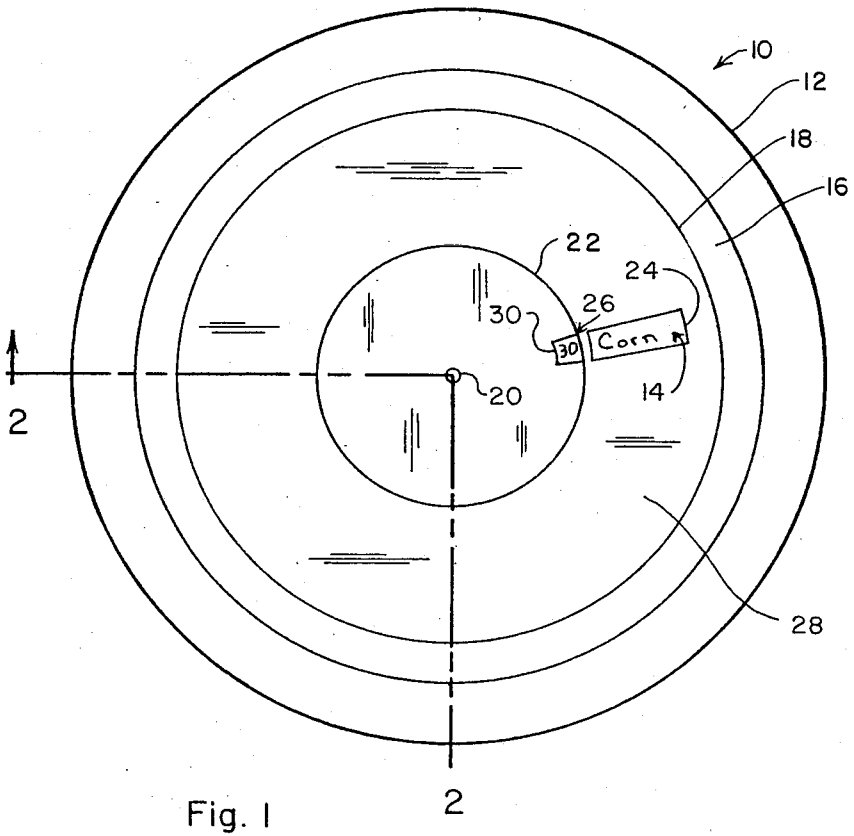
FIG. 1 is a top plan view of a lid construction according to the teachings of the present invention.
Figure 5:
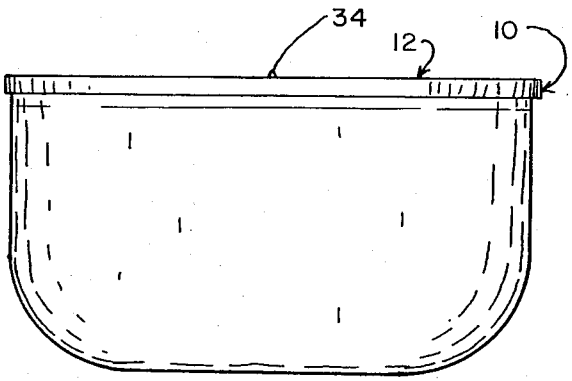

FIG. 1 illustrates a lid construction 10 constructed according to the teachings of the present invention. The lid construction 10 includes a lid member 12 having a first set of indicia 14 disposed upon the top surface 16 around the center thereof, each indicium of the first set of indicia 14 being adapted to identify one type of food. A first rotatable disc 18 is mounted on the lid member 12 and is rotatable relative thereto about a rod member 20 which extends through and upwardly from a center portion of the lid member 12. A second rotatable disc 22, which is smaller in diameter than the first rotatable disc 18, is mounted on top of the first rotatable disc 18 and is rotatable relative thereto about the rod member 20.

The first rotatable disc 18 includes a cut-out portion extending therethrough defining a window 24 along the circumference thereof and further includes indicia 26 disposed upon the top surface 28 thereof around the center. The second rotatable disc 22 also includes a cut-out portion extending therethrough defining a window 30 along the circumference thereof.

It is to be understood that the windows 24 and 30 may be located at any location on the respective discs 18 and 22 so long as the first rotatable member is adapted to be rotated to align the window 24 therethrough with the first set of indicia 16 disposed upon the lid member 12 to thereby identify the particular type of food stored in a bowl or the like and the second rotatable disc 22 is adapted to be rotated to align the window 30 therethrough with the second set of indicia 26 disposed upon the first rotatable disc 18 to thereby identify the particular date on which the food was stored in the bowl. Also, it is to be understood that additional rotatable discs may be added to display still other sets of indicia by mounting such discs on the lid member, disposing the other sets of indicia by mounting such discs on the lid member, disposing the other sets of indicia in a preferred arrangement and providing each rotatable disc with a window such that when the disc is rotated the window will be aligned with an indicium of one of the other sets of indicia.

Figure 2:
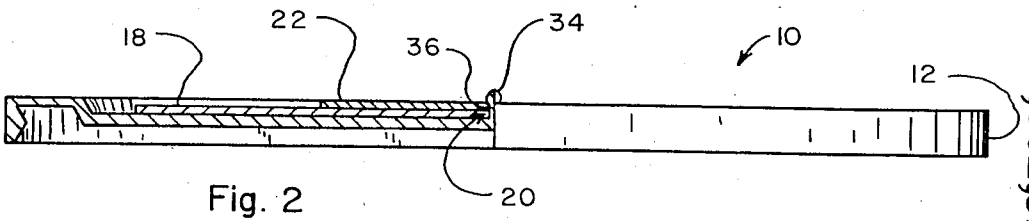
FIG. 2 is a partial cross-sectional view taken along lines 2—2 of FIG. 1 and showing removable first and second discs.
Figure 4:
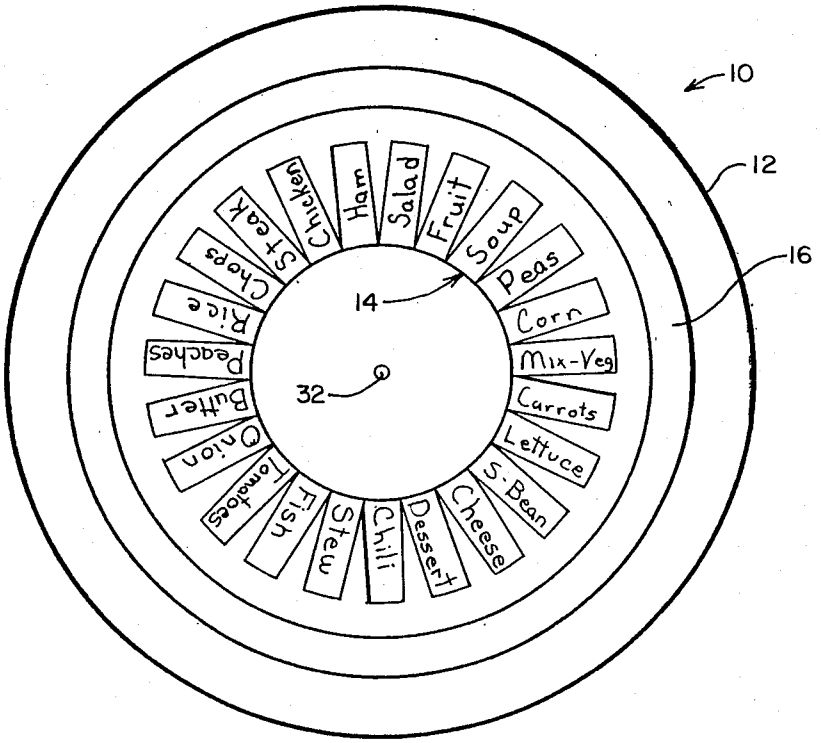
FIG. 4 is a top plan view of the lid construction of FIG. 1 showing the first and second rotatable discs removed; and, FIG. 5 is a side view of a bowl having a lid construction similar to that of of FIG. 1, showing a rod member adapted to permit the rotatable discs to be removed, disposed thereon.

The first and second rotatable discs 18 and 22 can be constructed so that they are removable from the lid member 12 so that each individual member can be cleaned independently. To accomplish this, each of the rotatable discs 18 and 22 includes an aperture 32 and the rod member 20 includes a tear-drop shaped member 34 (FIG. 2) adjacent the end portion 36 thereof and has a diameter slightly greater than the diameter of the aperture 32 of each disc. The tear-drop shaped member is forced through the aperture 32 of each of the discs 18 and 22 in order to mount the discs on the lid member 12 and by reversing this process each of the discs 18 and 22 can be removed.

It should also be noted that the first and second sets of indicia 16 and 26 can also be removable so that such indicia can be changed to identify other perishable goods, can be removed so that the first and second discs 18 and 22 can be cleaned or can be replaced when the original indicia becomes illegible. This can be accomplished by utilizing a strip of material having an adhesive backing and disposing the indicia on a front surface thereof.

Thus there has been shown and described a lid construction for bowls and the like which construction fulfills all of the objects and advantages sought therefor. It will be apparent to those skilled in the art after a review of this description, however, that many changes, modifications, variations, and other uses and applications for the subject constructions, in addition to those which have been disclosed, are possible and contemplated, and all such changes, modifications, variations, and other uses and applications which do not depart from the spirit and scope of the invention are deemed to be covered by the invention which is limited only by the claims which follow.

What is claimed is:

1. A lid construction adapted to be utilized on bowls and the like comprising a lid member having top and bottom surfaces, a first set of indicia disposed upon the top surface of the lid member, a rod member extending through and upwardly from a center portion of said lid member, and at least two rotatable disc members including a first rotatable disc member mounted on said lid member and rotatable relative thereto about said rod member, said first rotatable disc member including a cut-out portion extending therethrough defining a window and a second set of indicia disposed thereupon, a second rotatable disc member mounted on top of the first rotatable disc member and rotatable relative thereto about said rod member, said second rotatable disc member including a cut-out portion extending therethrough defining a window, whereby the first rotatable disc member is adapted to be rotated to align the window therethrough with selected indicium of the first set of indicia, and said second rotatable disc member is adapted to be rotated to align the window therethrough with selected indicium of the second set of indica.

2. The lid construction of claim 1 wherein said first and second rotatable discs are removable from the lid member.

3. The lid construction of claim 1 wherein the rod member includes a tear-drop shaped member adjacent one end thereof and spaced from the top surface of said lid member, and said first and second rotatable disc members are constructed of a substantially flexible material, each of said disc members including an aperture extending therethrough having a diameter less than the diameter of the tear-drop shaped member whereby said first and second disc members are removable from said lid member.

4. The lid construction of claim 1 wherein said first and second sets of indicia are removable.

5. The lid construction of claim 1 wherein each indicium of said first set of indicia identifies a type of food.

6. The lid construction of claim 1 wherein each indicium of said second set of indicia identifies a day of the month.

7. A lid construction adapted to be utilized on bowls and the like comprising a lid member having top and bottom surfaces, a first set of indicia disposed upon the top surface of the lid member, each indicuim of said first set of indicia being adapted to identify a type of food, a rod member extending through and upwardly from a center portion of said lid member, a first rotatable disc mounted on said lid member and rotatable relative thereto about said rod member, a second rotatable disc mounted on top of the first rotatable disc and rotatable relative thereto about said rod member, said first rotatable disc having a cut-out portion extending therethrough defining a window along the circumference thereof and a second set of indicia disposed thereupon, each indicium of said second set of indicia being adapted to identify a day of the month, said second rotatable disc having a cut-out portion extending therethrough defining a window along the circumference thereof, whereby the first rotatable disc is adapted to be rotated to align the window therethrough with selected indicium of the first set of indicia to thereby identify the type of food stored in a bowl, and said second rotatable disc is adapted to be rotated to align the window therethrough with selected indicium of the second set of indicia to thereby identify the day on which the food was stored in the bowl.

8. The lid construction of claim 7 wherein said first and second rotatable discs are removable from the lid member.

9. The lid construction of claim 7 wherein said first and second sets of indicia are removable.

* * * * *